US005782649A

United States Patent [19]

Aiken

[11] Patent Number: 5,782,649

[45] Date of Patent: Jul. 21, 1998

[54] POWER TOOL CORD LOCKING ASSEMBLY

[76] Inventor: Luke T. Aiken, R.F.D. #2, Box 128 - A, Sheffield, Vt. 05866

[21] Appl. No.: 905,003

[22] Filed: Aug. 11, 1997

Related U.S. Application Data

[63] Continuation-in-part of Ser. No. 685,001, Jul. 22, 1996, abandoned.

[51] Int. Cl.[6] ..... H01R 13/62

[52] U.S. Cl. ..... 439/369; 439/367; 439/368; 439/371

[58] Field of Search ..... 439/367–371, 439/373

[56] References Cited

U.S. PATENT DOCUMENTS

| | | | |
|---|---|---|---|
| 3,048,810 | 8/1962 | Steen | 439/367 |
| 3,551,879 | 12/1970 | Waller, Sr. | 439/369 |
| 4,475,649 | 10/1984 | Haarbosch | 439/367 |
| 4,643,505 | 2/1987 | House et al. | 439/368 |
| 4,917,625 | 4/1990 | Haile | 439/369 |
| 5,139,429 | 8/1992 | Herman et al. | 439/368 |
| 5,584,720 | 12/1996 | Elswick | 439/368 |
| 5,713,753 | 2/1998 | Bayer et al. | 439/369 |

*Primary Examiner*—J. J. Swann
*Attorney, Agent, or Firm*—Thomas N. Neiman

[57] ABSTRACT

The power tool cord locking assembly is designed to provide the user with a device that will prevent the electric plug on his or her power tool from unplugging from an electric extension cord or power outlet. The assembly comprises a unit having at least one housings, each housing has bottom portion and an open top portion. There are receiving slots in the end portions which are designed to receive the plug from the extension cord in one housing and the plug from the power tool in the other housing. The housings have extensions which are designed to be grasped and receive one end of elastic units on each side of the housings. The elastic devices are positioned as to connect the opposing handles creating a resistance for the housings and holding the electric plugs in position. In use, the operator would fasten the electric plugs together and position in the electric plugs in the opposing slots in the assembly. The elastic devices would hold the housings together, locking the plugs together securely despite almost any manipulation of the device.

7 Claims, 3 Drawing Sheets

POWER TOOL CORD LOCKING ASSEMBLY

BACKGROUND OF THE INVENTION

This is a continuation in part application of an application filed on 22 Jul. 1996, Ser. No. 08/685,001 which is abandoned.

This invention pertains to power tools, and in particular, to an assembly designed to be used with power tool cords to lock those power tool cords in position with an extension cord plug.

The use of power tools in the general population is wide spread and very common. One of the main difficulties experienced by the people using these tools is the necessity to constantly replace the plug on the ends of the power tool cord in the female plugs in extension cords and outlets when they come unplugged accidentally. They constantly pull away from each other. There have been a number of different attempts to deal with the problem. An example, are the battery powered power tools. One of the difficulties with these products is that they tend to run out of power at the wrong time. Another approach is to construct some sort of retention device at the end of the power tool cord itself.

What is needed is a simple, and effective, universal device which can be used with all extension cords and power tool cords. This should provide the user with an ease of operation for his or her activity and increase the speed at which the tasks are accomplished. It is also the object of this invention to provide an apparatus which is simple and fast to install and, at the same time, easy to manufacture, allow for use on a universal basis and be inexpensive to obtain.

It is the object of this invention to teach a power tool cord locking assembly which avoids the disadvantages and limitations, recited above in current plug connection locks.

SUMMARY OF THE INVENTION

Particularly, it is the object of this invention to teach a power tool cord locking assembly, for use in enabling the operator to hook a power tool to an extension cord and have it held securely through almost all manipulations of the power tool, comprising unit of at least one housing; said housing comprising a structure having an open top portion; said housing further comprising a structure having arcuate side and bottom portions; said housing further comprising a structure having one end having a receiving slot positioned therein, and having the end opposite said receiving slot end being totally open; said housing further comprising a structure having extension means located on both arcuate sides of said structure; and retention means to be positioned within said extension means on each of said arcuate sides of said structure of said housing.

BRIEF DESCRIPTION OF THE INVENTION

Further objects and features of this invention will become more apparent by reference to the following description taken in conjunction with the following figures, in which.

DESCRIPTION OF THE PREFERRED EMBODIMENTS

Figure 2:
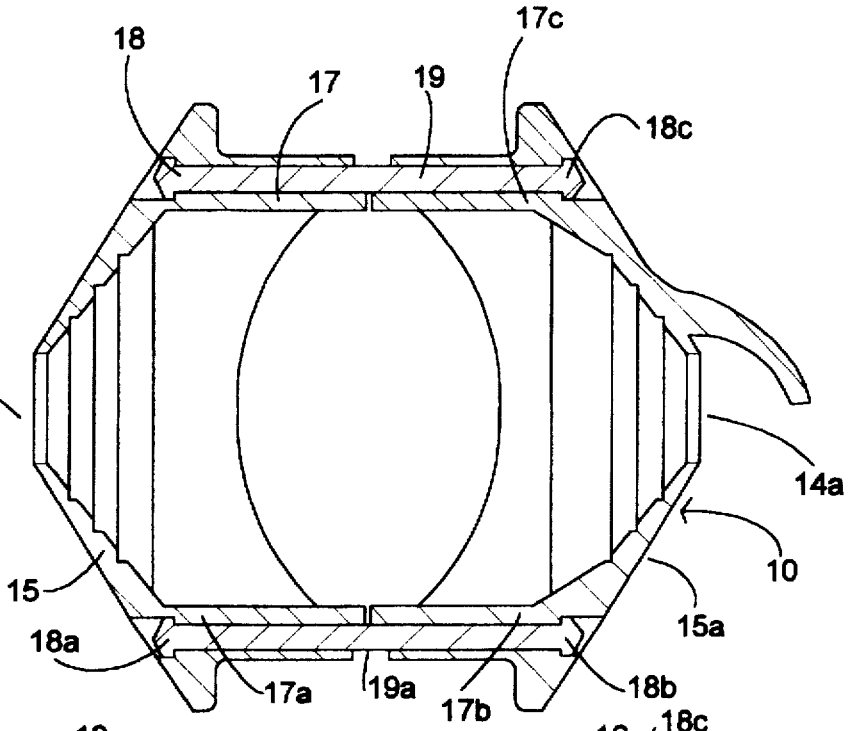
FIG. 2 is a cross sectional view thereof.
Figure 1:
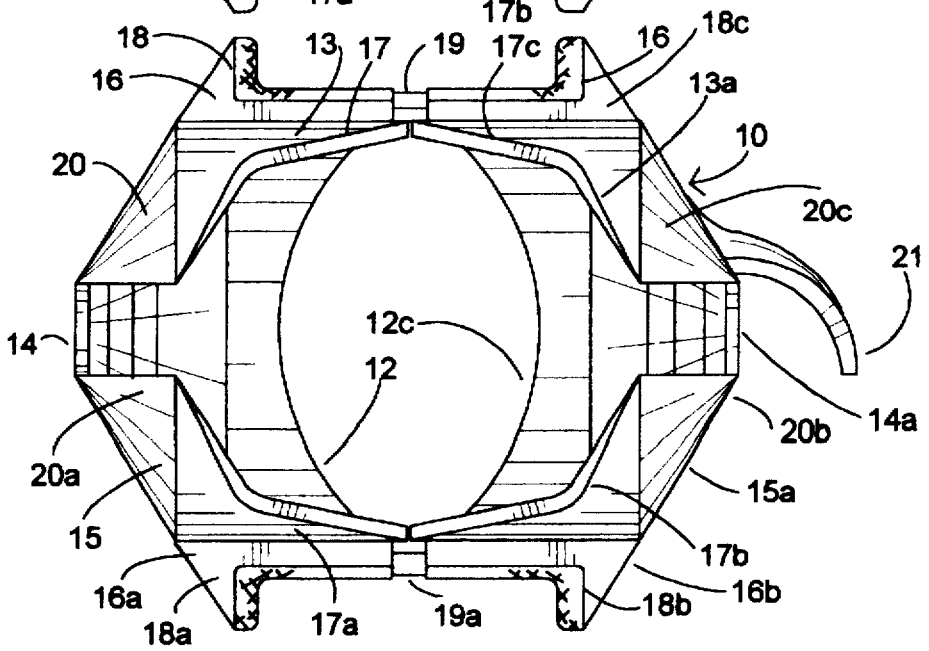
FIG. 1 is a top plan view of the novel power tool cord locking assembly.
Figure 3:
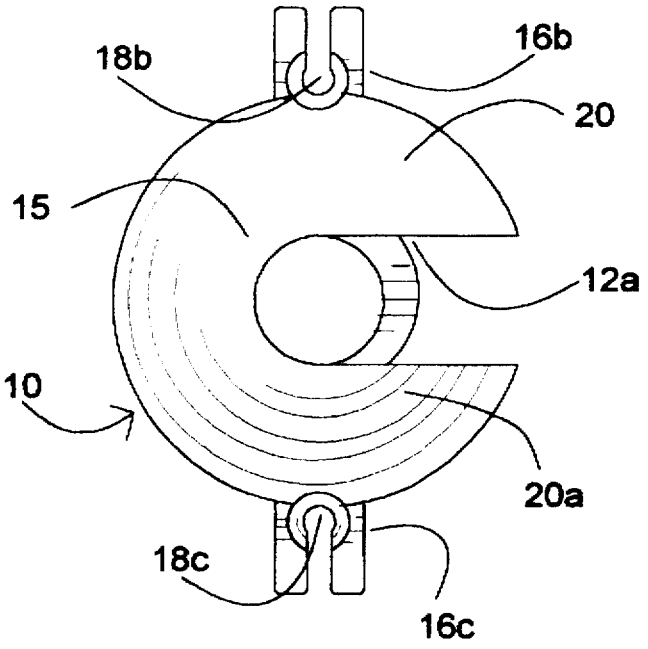
FIG. 3 is an end elevational view thereof.
Figure 4:
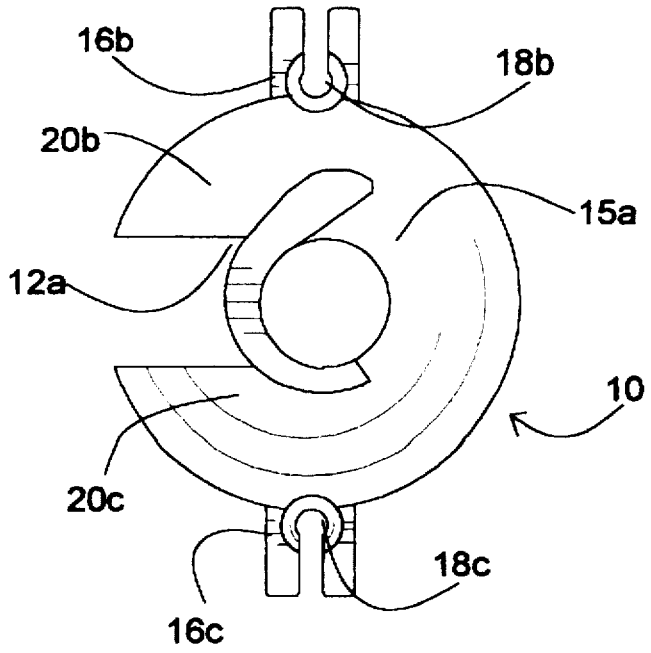
FIG. 4 is an end elevational view of the opposite end of the two housings.
Figure 5:
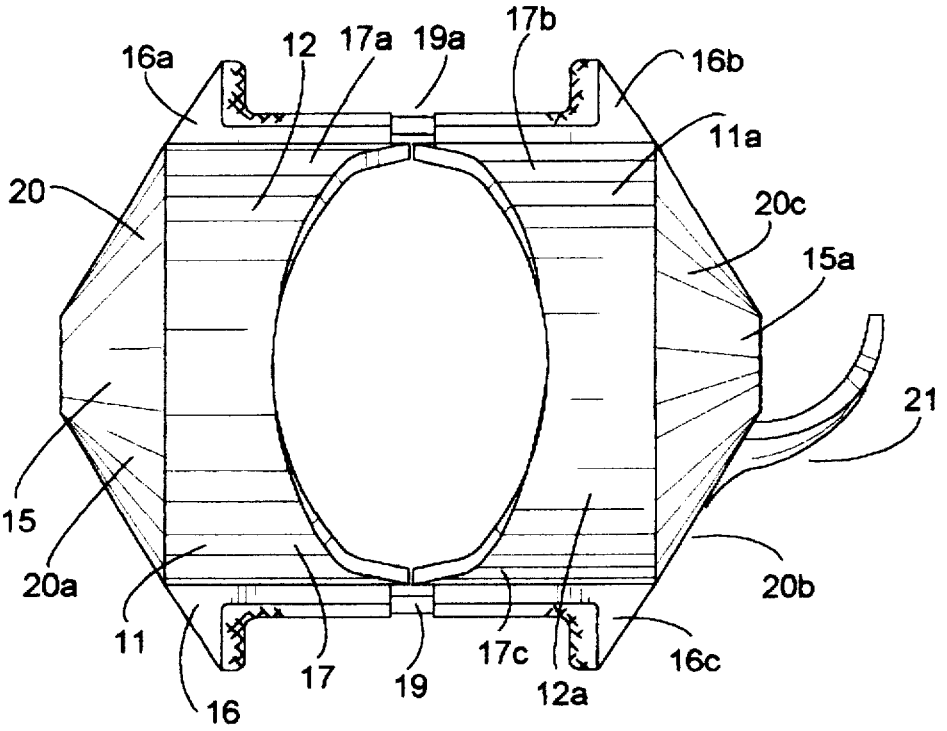
FIG. 5 is a bottom plan view thereof.
Figure 6:
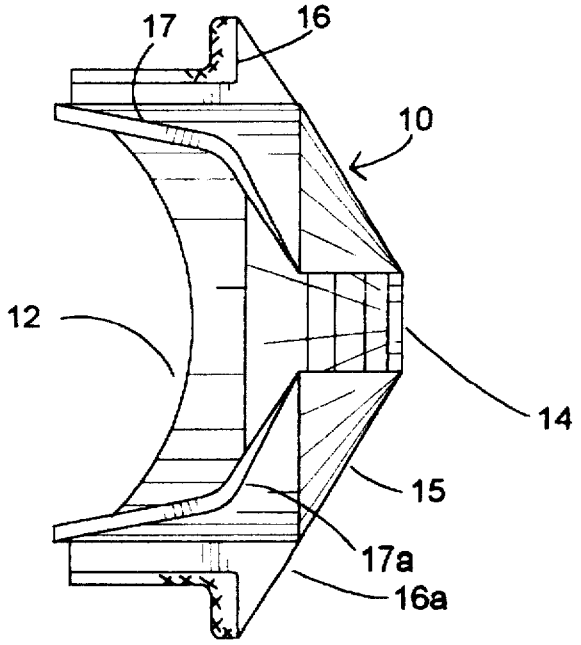
FIG. 6 is a top plan view of the single housing embodiment thereof.

As shown in the figures, the novel power tool cord locking assembly 10 comprises a unit having at least one housing 11, most assemblies will have a second housing 11*a*, each having a partially open bottom portion 12 and 12*a* and a top portion 13 and 13*a*. The housing is typically constructed of a lightweight material having strength and flexibility, such as plastic. Each of the housings have end wall sections 15 and 15*a* respectively that have receiving slots therein. End wall sections 15 and 15*a* contain receiving slots 14 and 14*a* that are designed to receive the power tool cord and extension cord. Interior ends of each housing are completely open areas. The arcuate sides 17, 17*a*, 17*b* and 17*c* of the housings 11 and 11*a* have extension handles 16, 16*a*, 16*b* and 16*c* located at the sides of the housings 11 and 11*a*. These handles 16, 16*a*, 16*b* and 16*c* have receiving slots 18, 18*a*, 18*b* and 18*c*. The handles are roughened to provide an anti-slip surface. These handles 16, 16*a* 16*b* and 16*c* and their corresponding retention slots 18 through 18*c* are designed to have resilient means such as elastic bands 19 and 19*a* or flexible synthetics or rubber inserted therein to ensure that the two housings 11 and 11*a* would not open up when the cords are slackened up. The handles 16, 16*a*, 16*b* and 16*c* and the angled or tapered portions 20, 20*a*, 20*b* and 20*c* of the end walls sections 15 and 15*a* are designed to minimize hang ups of the cords on the assembly 10 or of the assembly on other objects. The inner surface of the housing is tapered and contains grooves therein in order to keep the plug ends centered in the assembly. An angled projection 21 found on one exterior side wall section is designed to hold the cord when not in use for easy access when the user wants to replug and use the cords.

In operation, the user would place the plug of the power tool cord into the plug in the extension cord. The entire connection would then be placed into the receiving slots in the assembly. This would make it very difficult for the plugs to become separated no matter how the power tool is manipulated.

While I have described my invention in connection with specific embodiments thereof, it is clearly to be understood that this is done only by way of example and not as a limitation to the scope of my invention as set forth in the objects thereof and in the appended claims.

I claim:

1. A power tool cord locking assembly, for use in enabling an operator to hook a power tool to an extension cord and have it held securely through almost all manipulations of the power tool, comprising:

a housing having an open top portion for receiving an assembled power tool and extension cord connection;

said housing further comprising two separate structures, each structure configured to hold a single connector portion, each said structure having arcuate side and bottom portions;

each said structure having one end having a receiving slot positioned therein and the end opposite said receiving slot end being totally open;

said housing further having extension means located on both arcuate sides of each said structure; and retention means to be positioned within said extension means on each of said arcuate sides of each said structure of said housing to retain said structures as a unitary housing, thereby holding the power tool and extension cord securely together.

2. A power tool cord locking assembly, according to claim 1, wherein:

said housing comprise units constructed of a lightweight material having both strength and flexibility;

an inner portion of said housing having a tapered finish; and said inner portion of said housing further having grooves positioned therein for facilitating retention of said cord means.

3. A power tool cord locking assembly, according to claim 1, wherein:

said open top portion of said structure comprises a device having angled cuts which provide an totally open area at said end opposite said receiving slot portion of said structure and a partially enclosed section adjacent to said end ad having said receiving slot.

4. A power tool cord locking assembly, according to claim 1, wherein:

said arcuate bottom portion of said structure comprises a partially enclosed area having a large open section.

5. A power tool cord locking assembly, according to claim 1, wherein:

said extension means on said receiving sections comprise handle means for said assembly;

said handle means having retention slots in said handle means for holding said retention means in position on the sides of said receiving sections;

said handle means further having anti slip means;

anti slip means on said handle means comprises an area of surface checking;

said handle further having arcuate edges thereon; and said handle means on said receiving sections comprise units constructed of rigid materials.

6. A power tool cord locking assembly, according to claim 1, wherein:

said retention means comprise elastics constructed of rubber or synthetic compounds.

7. A power tool cord locking assembly, according to claim 1, wherein:

said housing further comprising a structure having an angled protrudence on one of said housings; and said angled protrudence comprises a cord guide feature for holding said locking assembly on said cord when not in use to facilitate access when needed for reuse.

* * * * *